US006632121B2

(12) United States Patent
Edmisson et al.

(10) Patent No.: US 6,632,121 B2
(45) Date of Patent: Oct. 14, 2003

(54) TOY VEHICLE REMOVABLE WHEEL CONNECTION

(75) Inventors: Russell Edmisson, Westport, CT (US); Peter Asher, Escondido, CA (US)

(73) Assignee: X Concepts, LLC, Escondido, CA (US)

( * ) Notice: Subject to any disclaimer, the term of this patent is extended or adjusted under 35 U.S.C. 154(b) by 0 days.

(21) Appl. No.: 10/174,227

(22) Filed: Jun. 17, 2002

(65) Prior Publication Data

US 2003/0003842 A1 Jan. 2, 2003

Related U.S. Application Data

(60) Provisional application No. 60/299,235, filed on Jun. 19, 2001.

(51) Int. Cl.[7] ..... A63H 17/26
(52) U.S. Cl. ..... 446/471; 446/469
(58) Field of Search ..... 446/471, 470, 446/465, 468, 469; 301/118, 64.701, 111.03

(56) References Cited

U.S. PATENT DOCUMENTS

| | | | | | |
|---|---|---|---|---|---|
| 1,984,258 | A | | 10/1934 | Dowst | |
| 1,991,654 | A | | 2/1935 | Brubaker | |
| 2,632,675 | A | * | 3/1953 | Richard | 301/35.61 |
| 3,048,447 | A | * | 8/1962 | Klint | 301/64.707 |
| 3,062,254 | A | * | 11/1962 | Keefe | 152/7 |
| 3,238,666 | A | | 3/1966 | Gigl | |
| 3,638,356 | A | * | 2/1972 | La Branche | 446/465 |
| 3,817,581 | A | * | 6/1974 | Maxam | 301/6.1 |
| 3,924,352 | A | * | 12/1975 | Goldfarb et al. | 446/90 |
| 3,985,392 | A | * | 10/1976 | Bergmann et al. | 301/64.706 |
| 4,061,339 | A | | 12/1977 | Coster | |
| 4,114,952 | A | * | 9/1978 | Kimmell | 301/5.7 |
| 4,193,639 | A | * | 3/1980 | Pauly et al. | 301/35.61 |
| 4,299,051 | A | | 11/1981 | Pauly et al. | |
| 4,840,599 | A | | 6/1989 | Ming | |
| 4,900,095 | A | * | 2/1990 | Brubaker | 301/64.706 |

FOREIGN PATENT DOCUMENTS

| | | |
|---|---|---|
| DD | 251291 A1 | 11/1987 |
| FR | 2616352 | 6/1987 |

* cited by examiner

*Primary Examiner*—Derris H. Banks
*Assistant Examiner*—Faye Francis
(74) *Attorney, Agent, or Firm*—Kenneth K. Wright

(57) ABSTRACT

The present invention relates to a wheel connection for a toy vehicle. The wheel connection utilizes a disc component which is attached to the vehicle suspension arm and a sleeve component which is attached to the vehicle wheel rim. The disc has a groove along its outer edge and the sleeve has a number of deformable outwardly extending tabs positioned on its inner wall. The disc and disc groove and the sleeve and sleeve tabs are sized so as when the wheel rim/sleeve assembly is pushed on to the suspension arm/disc assembly, the tabs first deform until they align with the groove, whereupon the tabs regain their non-deformed shape, within the profile of the disc groove. Similarly, when the wheel rim/sleeve assembly is pulled from the suspension arm/disc assembly, the tabs again deform until they are clear of the disc's outer edge, whereupon the tabs regain their non-deformed shape.

5 Claims, 4 Drawing Sheets

TOY VEHICLE REMOVABLE WHEEL CONNECTION

This application claims the benefit of Provisional Application No. 60/299/235, file Jun. 19, 2001.

TECHNICAL FIELD

The present invention relates to the field of scale model toy vehicles. More particularly, the present invention relates to a wheel connection that allows a wheel to be easily removed from such toy vehicles and replaced with a different wheel.

BACKGROUND OF THE INVENTION

Known wheels for toy vehicles have generally been permanently affixed to an axle. Known removable wheels typically utilize a nut and bolt configuration. The nut and bolt configuration is undesirable because it is difficult to remove and replace the wheel, and it renders the wheel visually unrealistic when compared to full-size custom wheels which are installed to enhance the visual appeal and/or performance of the vehicle. A need has been determined for a toy vehicle featuring authentic-looking wheels, where the wheels an be quickly and easily interchanged with different sized and styled wheels using a push-on/pull-off connection that is inexpensive to manufacture and can withstand repeated use.

BRIEF SUMMARY OF THE INVENTION

The object of the present invention is to provide a coaxial connection between a wheel and an element of a toy vehicle, such as a brake disc, hub, or axle, that enables the wheel to be easily removed and replaced with another wheel. The replacement wheel may differ in terms of visual styling, and/or outside wheel diameter, and/or wheel width, and/or color, and/or tire style, and/or by other means. This will enable the user to interchange wheels on the toy vehicle to alter the appearance and size of wheel, much like persons do to customize full-size vehicles. The present invention provides for a manual push-on/pull-off connection between a wheel and an element of the toy vehicle, such that a child can remove and replace the wheel easily, and that this removal and replacement can be repeated. With respect to any of the elements of the vehicle to which the wheel is attached, the connection between wheel and vehicle element will consist of a means for a semi-permanent connection between the wheel and the vehicle element, so as there is minimal axial movement between the wheel and element, but there is full rotational movement of the wheel around the axis of the vehicle element. The present invention may be further understood by consideration of the following drawings and associated description.

BRIEF DESCRIPTION OF THE DRAWINGS

1.

2.

3.

4.

5.

6.

DETAILED DESCRIPTION OF THE INVENTION

Figure 1:
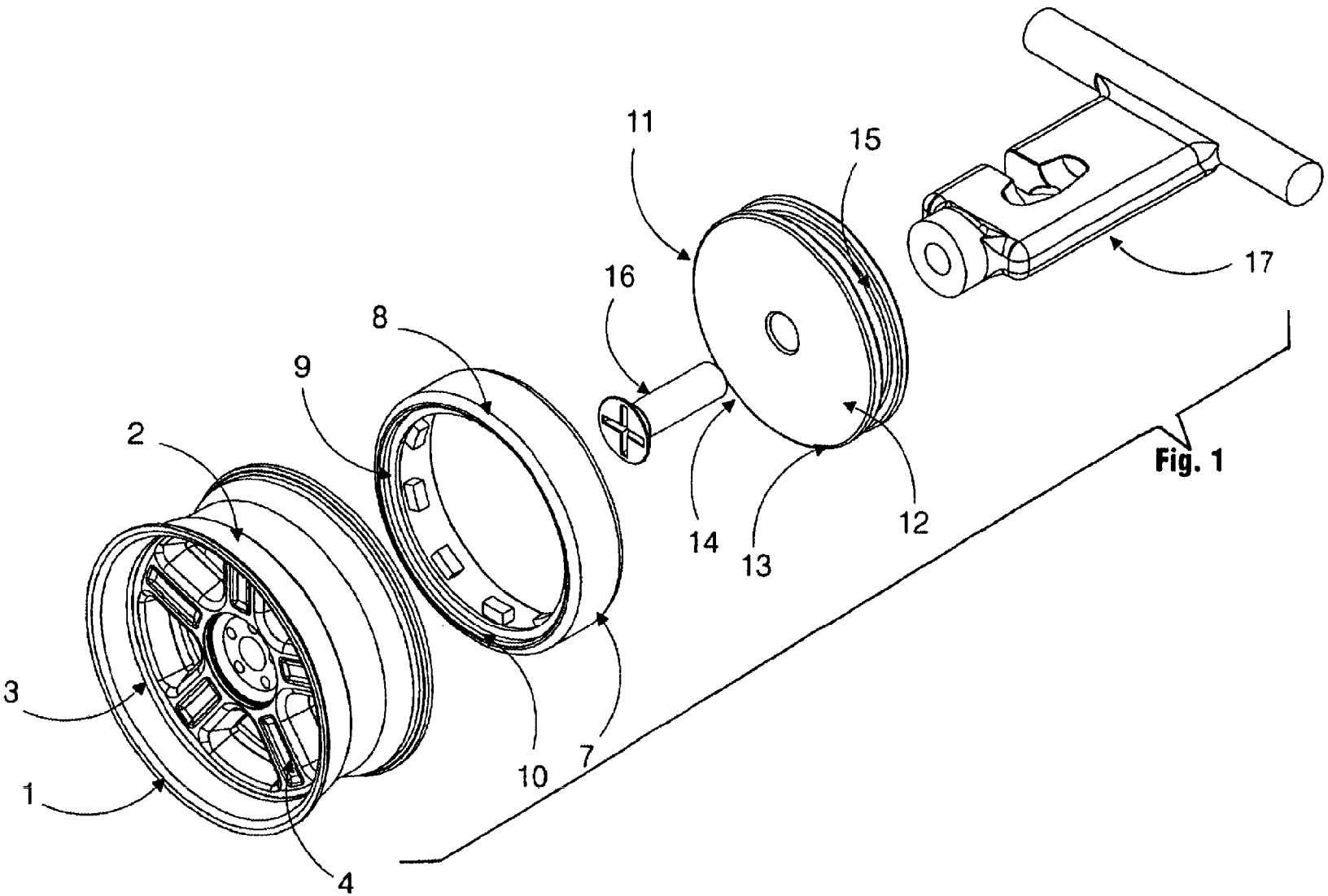
FIG. 1 is an exploded view of the toy vehicle removable wheel connection device, illustrating the preferred embodiment of the invention.

Referring to FIG. 1 of the drawings, the connection device shown may be used on any of various toy vehicles such as a passenger car, pick-up truck, sports utility vehicle, stock car, racing car, and the like.

Figure 3:
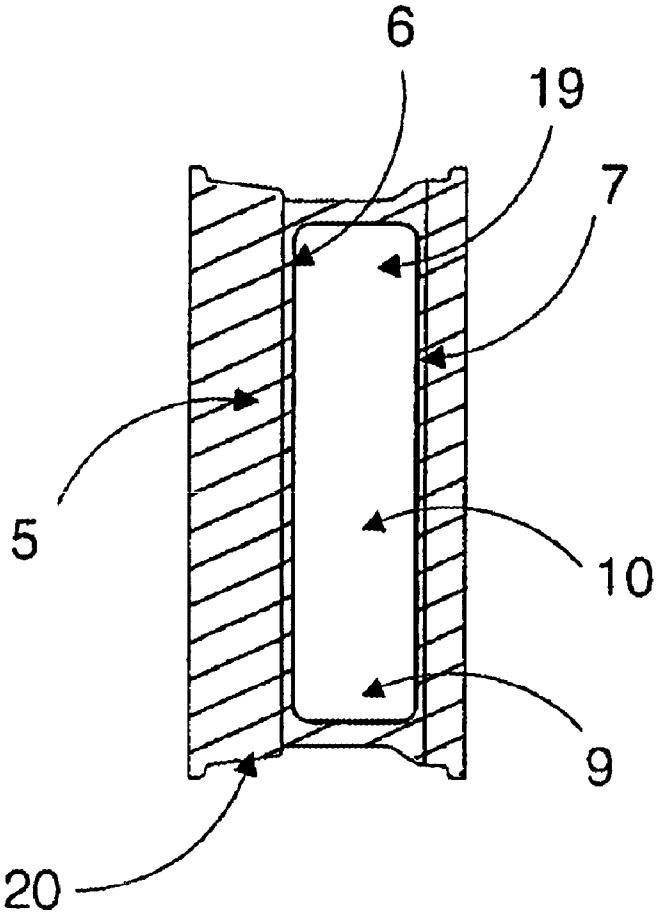
FIG. 3 is a side view in section of the wheel assembly.
Figure 2:
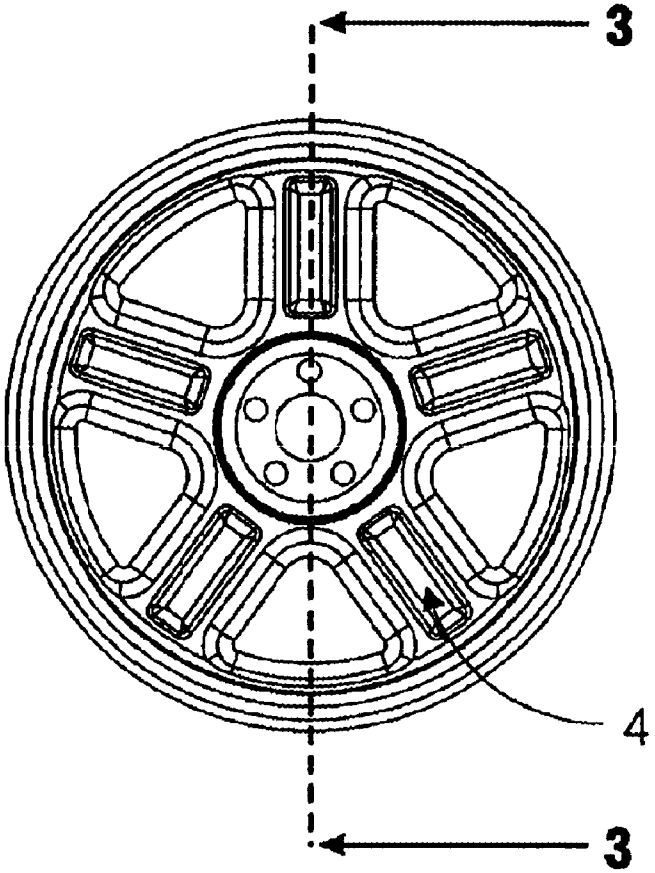
FIG. 2 is a front view of the wheel assembly.

The wheel rim 1 in FIG. 1 has a radial outer wall 2 upon which a tire can be mounted. The wheel rim 1 also has a radial inner wall 3. The wheel rim 1 has a center portion 4 which circumference is defined by the wheel rim inner wall 3. Referring to FIGS. 1, 2 and 3, the wheel rim center portion 4 has a front face 5 and a back face 6. The front face 5 has the visual appearance of a custom wheel. The center portion 4 is located axially within the wheel rim inner diameter 3, such that the back face 6 and the inner diameter of the wheel rim 3 create a space for the insert sleeve 7 to fit inside. There may also be a stop mechanism positioned within this space in addition to the insert sleeve 7 or alternatively a stop mechanism may be included as part of the insert sleeve 7 (insert sleeve stop mechanism shown on drawings as a ring). The function of the stop mechanism is to prevent damage to the wheel assembly and/or safety to the child during removal and/or replacement of the wheel.

Referring again to FIG. 1, the radial outer wall of the insert sleeve 8 is affixed to the radial inner wall of the wheel rim 3, using a permanent fixing method such as an adhesive. The radial inner wall of the insert sleeve 9 provides a means for a semi permanent connection with the vehicle element 11. In the preferred embodiment, the semi permanent connection is achieved by the radial inner wall of the insert sleeve 9 having a plurality of radially outwardly extending tabs or wall structures 10. These extending tabs or wall structures of the insert sleeve 10 are flexible so that they deform under force, but regain their former shape once the force is removed.

Figure 4:
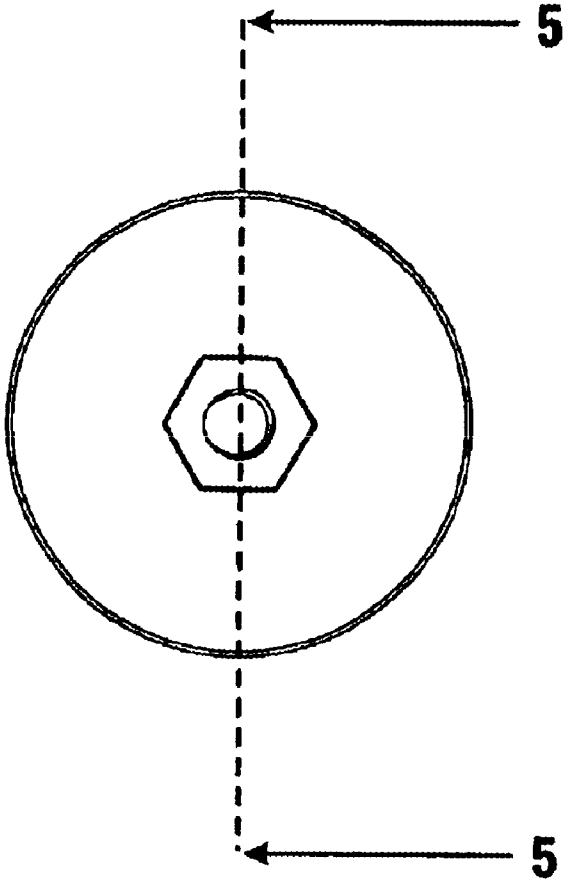
FIG. 4 is a front view of the vehicle element assembly.
Figure 5:
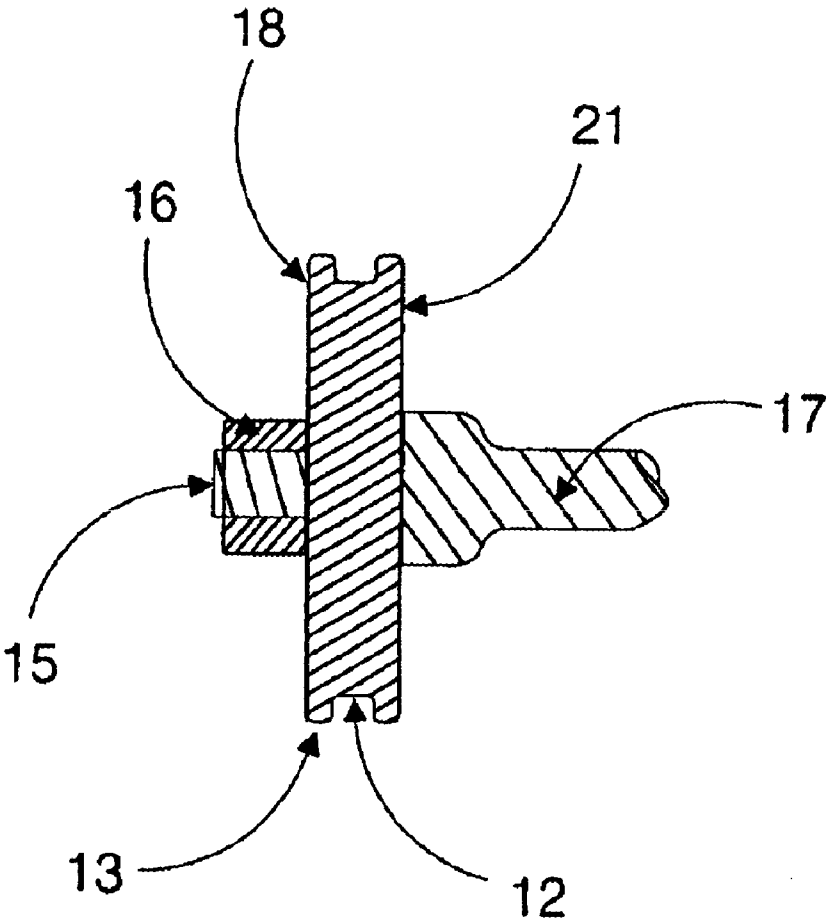
FIG. 5 is a side view in section of the vehicle element assembly.

Referring to FIGS. 1, 4 and 5, the vehicle element 11, such as a brake disc as shown in FIG. 1, has an annular groove 12 in the radial outer edge 13. The profile of the annular groove 12 is sized to permit a snug fit with the tabs 10 in their non-deformed state. The center of the vehicle element 11 has an aperture 14, that could be defined by a radial inner wall or other geometric shape such as a polygon, that is sized to allow the means for fixation to the suspension arm 15 to be inserted, so that a fixing device 16, such as a screw, nut or a friction-fit, can affix the vehicle element 11 to the suspension arm 17.

Figure 6:
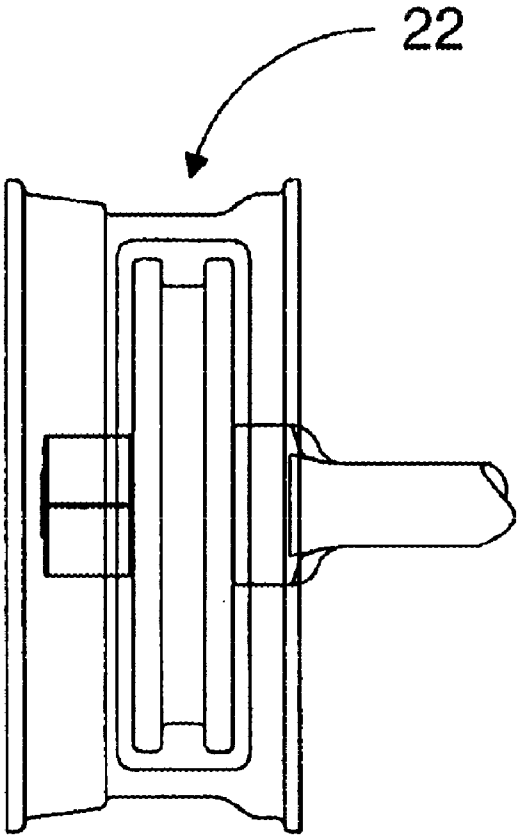
FIG. 6 is a side sectional view of the wheel and vehicle element assemblies in their connected position.

The foregoing describes the components that combine to form the connection device assembly, which may be further understood by consideration of FIGS. 2 and 3, the wheel assembly, and FIGS. 4 and 5, the vehicle element assembly. The assemblies illustrated in FIGS. 2, 3, 4 and 5 are connected and disconnected (method of assembly) as follows:

To assemble the wheel assembly of FIGS. 2 and 3 with the vehicle element assembly of FIGS. 4 and 5, (as illustrated by FIG. 6, showing the wheel and vehicle element assemblies in their connected state), and referring to FIGS. 2, 3, 4 and 5, the wheel assembly 20 is axially presented to the vehicle element assembly 21, such that the wheel rim center portion front face 5 faces outward and away from the vehicle element 11. In this preferred embodiment, the two assemblies (20 & 21) are mated such that the radial outer edge of the vehicle element 13 is fitted within the radial inner diameter of the insert sleeve 9, and the front face of the vehicle element 18 contacts the outer side of the inner sleeve tabs 19. Sufficient axial pushing force is then applied to the wheel assembly 20, to overcome the resiliency of the flexible tabs of the insert sleeve 10. This allows the front face of the vehicle element 18 to move beyond the outer side of the inner sleeve tabs 19, until the tabs 10 align with the annular groove of the vehicle element 12 and/or the front face of the vehicle element 18 contacts the stop mechanism. As the tabs 10 are in alignment with the annular groove 12, there is no longer any force being applied to the tabs 10 via the radial outer edge 13, and the tabs 10 therefore regain their former shape, and fit snugly within the annular groove of the vehicle element 12. The wheel assembly 20 is now connected in the axial plane to the vehicle element assembly 21, as illustrated in FIG. 6, 22. The wheel assembly 20 can be moved rotationally by applying appropriate manual force, with the necessary axial alignment being provided by the annular groove 12 which now houses the tabs 10.

In order to dismount the wheel assembly 20 in it's preferred embodiment, sufficient axial pulling force is applied to the wheel assembly 20, to overcome the resiliency of the flexible tabs of the insert sleeve 10.

Various modifications can be made without departing from the broader scope of the present invention. The purpose of the present invention is to allow removal and replacement of wheels with different looking and different size wheels as persons can do to customize full size vehicles. The removal and replacement of toy vehicle wheels is achieved using a push-on and pull-off means and it should be recognized that this can be achieved in a variety of ways and that the invention described is just one such embodiment. The scope of the present invention is intended to include such other ways within the scope and spirit of the invention, as defined by the appended claims. It should also be recognized that the outer face of the center portion of the wheel rim 6 will have a range of styles, in order to replicate the styles of full size custom wheels, and that the relative width of the wheel rim and outside diameter of the wheel rim will also come in ranges for the same purpose.

What is claimed is:

1. A toy vehicle wheel connection, comprising:

(a) a toy vehicle wheel rim having an inner diameter and a center portion;

(b) an insert sleeve having a radial outer wall and a radial inner wall, where said radial outer wall is permanently affixed to said inner diameter, and said radial inner wall has a plurality of radially outwardly extending tabs;

(c) a vehicle element having a radial outer edge with an annular groove, said outer edge sized to fit within said inner wall, and said annular groove sized to provide a snug fit with said extending tabs.

2. The toy vehicle wheel connection of claim 1, wherein said extending tabs are flexible so that they deform under force, but regain their former shape once the force is removed.

3. The toy vehicle wheel connection of claim 2, wherein said vehicle element has means for fixation to a toy vehicle suspension arm.

4. The toy vehicle wheel connection of claim 3, wherein said insert sleeve has a stop mechanism.

5. The toy vehicle wheel connection of claim 4, wherein said center portion has the visual appearance of a custom wheel.

* * * * *